United States Patent [19]

Rector, Jr.

[11] Patent Number: 4,471,841

[45] Date of Patent: Sep. 18, 1984

[54] PRESSURE BALANCED VALVE

[75] Inventor: Clarence A. Rector, Jr., Farmington, N. Mex.

[73] Assignee: El Paso Exploration Company, El Paso, Tex.

[21] Appl. No.: 420,870

[22] Filed: Sep. 21, 1982

[51] Int. Cl.[3] ..... E21B 34/14

[52] U.S. Cl. ..... 166/325; 166/332; 251/324

[58] Field of Search ..... 166/332–334, 166/324, 325; 251/324, 339, 284, 282; 137/625.37, 625.69

[56] References Cited

U.S. PATENT DOCUMENTS

| | | | |
|---|---|---|---|
| 2,326,867 | 8/1943 | Kinney | 251/78 |
| 2,815,925 | 12/1957 | Fisher, Jr. | 251/347 |
| 2,858,099 | 10/1958 | Althouse, Jr. et al. | 251/347 |
| 2,970,470 | 2/1961 | Kenneday | 73/151 |
| 2,995,337 | 8/1961 | Tanner | 251/324 |
| 3,040,812 | 6/1962 | Howard | 166/332 X |
| 3,042,116 | 7/1962 | Sharp et al. | 166/179 |
| 3,059,700 | 10/1962 | Loy et al. | 166/332 |
| 3,426,998 | 2/1969 | Knitner | 251/324 |
| 3,581,819 | 6/1971 | Tamplen | 166/332 |
| 3,987,848 | 10/1976 | Canterbury | 166/321 |
| 4,340,088 | 7/1982 | Geisow | 166/332 X |

*Primary Examiner*—Stephen J. Novosad
*Assistant Examiner*—Thuy M. Bui
*Attorney, Agent, or Firm*—Bacon & Thomas

[57] ABSTRACT

A pressure balanced valve is disclosed which minimizes the force necessary to move the valve between an opened and a closed position even when used to shut off the flow of a high pressure fluid. The valve stem in combination with a pressure relief port on the valve stem balances the pressures acting on the valve to relieve any differential pressure which would tend to maintain the valve either open or closed. In the absence of any differential pressure, the valve stem is not forced in any direction since the resultant of the forces due to the cross-sectional areas of the valve stem is zero, i.e., all of the forces are cancelled. The balancing of the pressure is achieved by a series of passages in the valve body which are selectively interconnected by movement of a valve stem within the body. The invention may be utilized in a down-hole well environment or in above-ground piping systems.

16 Claims, 13 Drawing Figures

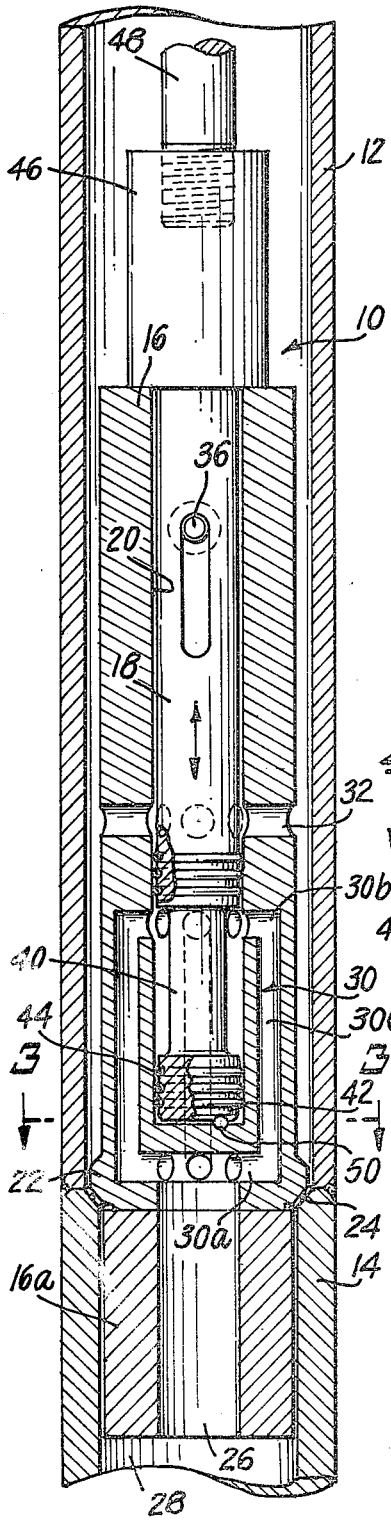
CLOSED
Fig. 1
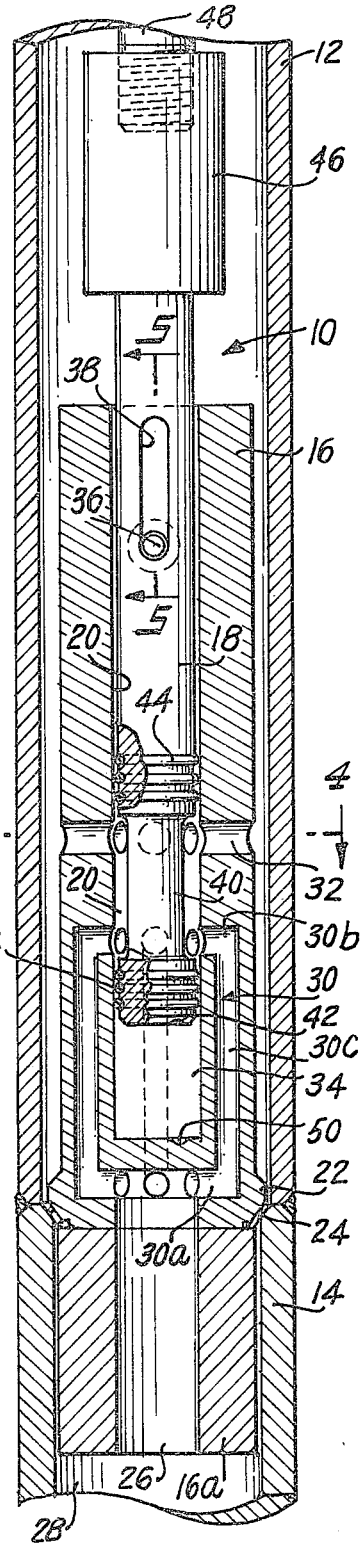
OPEN
Fig. 2
Fig. 5
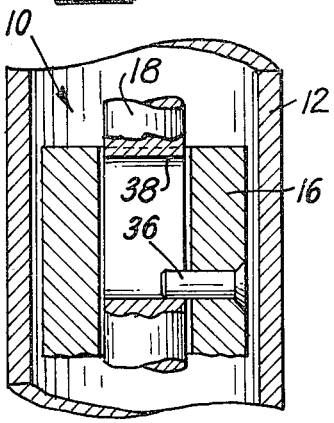
Fig. 3
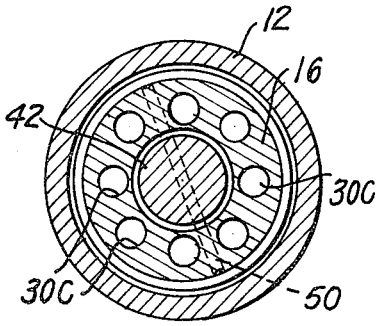
Fig. 4
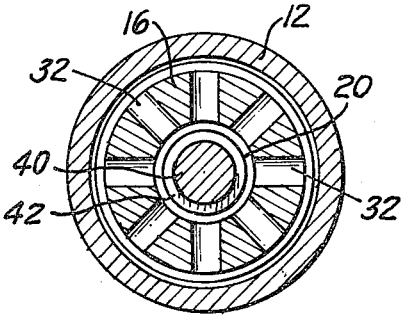

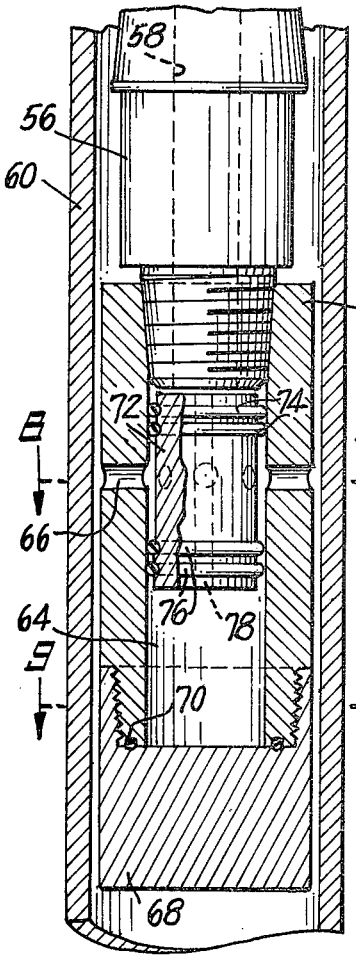
CLOSED
Fig. 6
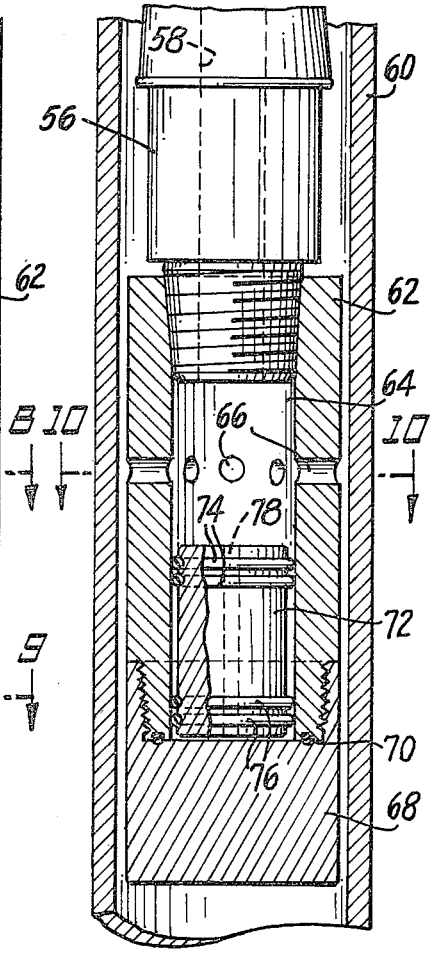
OPEN
Fig. 7
Fig. 5A
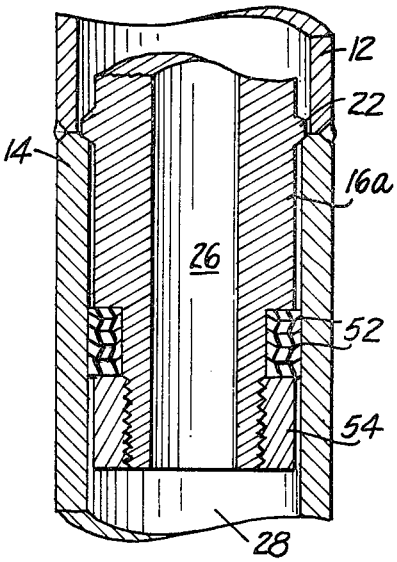
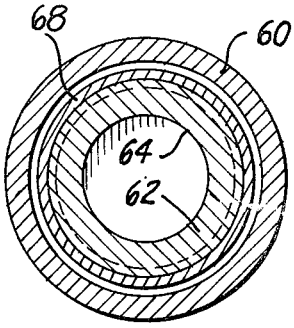
Fig. 9
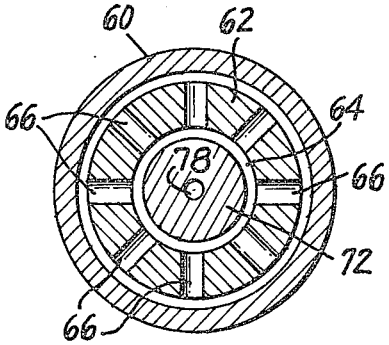
Fig. 8
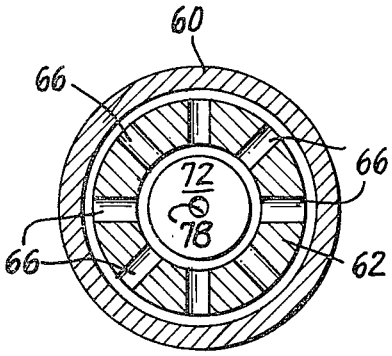
Fig. 10

OPEN

CLOSED

PRESSURE BALANCED VALVE

FIELD OF THE INVENTION

The instant invention relates to pressure balanced valves which minimize the valve actuating force regardless of the fluid pressure in the system in which the valves are installed.

BRIEF DESCRIPTION OF THE PRIOR ART

Many different varieties of valves have been developed over the years, among them a gate valve, in which a generally planar valve element moves perpendicularly to the fluid flow direction, a ball valve in which a ball-shaped element having a passage therethrough is rotated about an axis oriented generally perpendicularly to the fluid flow, and a check valve in which a valve element is biased against a valve seat by a spring force. Although generally these type of valves have worked exceedingly well over the years, problems have arisen with their operation when they are used in high pressure fluid systems. The large pressure differential across the valve when the valve element is closed requires a large external force to move the valve elements to their open position. For example, a 1000 psi differential pressure across a gate or ball valve with a circular sealing area of two inches diameter exerts a force of 3140 pounds against the valve seal. The external force required to open valves under these conditions is excessive, even when mechanical systems, such as worm gear drives, are incorporated into the valve structure.

The aforementioned problems become even more crucial when the valve is used in a remote location, such as a down-hole well environment. It is often necessary to seal off a well, such as a high pressure gas well, at some point along its length in order to hydrotest the well tubing to locate leaks, or to perform other routine maintenance. The extremely high pressures associated with gas wells (on the order of 2400 psi) makes the operation of standard gate and ball valves an exceedingly difficult and time consuming proposition and, in the extreme cases, renders their usage virtually impossible. Quite obviously, it is in the economic interest of the well operator to minimize the down-time required to hydrotest the tubing or perform other routine maintenance. Any valve structure which would minimize this time would be of great economic benefit to the industry.

SUMMARY OF THE INVENTION

The instant invention provides a pressure balanced type valve which requires minimal actuating force to open and close the valve, regardless of the pressure differential across the valve. The configuration of the valve stem in combination with a pressure relief port on the valve stem seat relieves any differential pressure. In the absence of differential pressure, the valve stem is not forced in any direction, as the resultant of the forces acting on the cross-sectional areas of the valve stem is zero. In its broadest configuration, the valve has an enlarged area on either end of the stem and is located such that, when the valve is in the closed position, one of the enlarged areas blocks the fluid flow passage. The longitudinal axis of the valve stem is oriented such that it moves generally perpendicular to the fluid flow path. Since the enlarged portions are of equal area, the fluid bearing against these opposed enlarged areas does not exert a resultant force and, therefore, exerts no force against the valve stem tending to restrict its movement.

Since the forces generated by the pressurized fluid tend to cancel each other out, the valve stem may be moved with minimal effort, regardless of the level of fluid pressure in the system.

In one application of the valve, the aforementioned valve stem is incorporated in a valve body which, in turn, may be lowered into well tubing to block off fluid flow at a desired location. The valve stem may be readily moved with respect to the valve body to open and close the valve even at such a remote location, using ordinary tools available at a well site. In one embodiment, the valve stem is slidably retained in the valve body by a shear pin such that, if the valve body becomes jammed in the tubing, the valve stem may be removed by exerting a force thereon sufficient to cause the shear pin to break.

The same principles may be utilized in a surface type valve having the valve stem directly connected to a handle or other manually manipulable means. In this configuration, one of the enlarged areas has a length sufficient to block the inlet and outlet passage in the valve body when in the closed position. When in the opened position, the fluid passes between the enlarged areas and around a reduced diameter stem which is positioned between the inlet and outlet. Since, in both the opened and closed positions, the resultant forces caused by the fluid pressure acting on the valve stem cancel each other out, the stem may be readily moved with minimal effort.

In another alternative embodiment, the principles of this invention may be accomplished by incorporating a central passageway extending completely through the valve stem in the longitudinal direction to allow fluid on one side of the enlarged area to communicate with the fluid on the other. This configuration is particularly useful when the valve is designed as a check valve which is manually movable between the opened and closed position, and vice versa. When in the closed position, one of the two enlarged areas is interposed between the valve inlet and outlet to thereby preclude fluid flow. The valve will not move since the enlarged sections are of equal area and are acted upon by equal pressures. When it is desired to open the valve, the valve element is manually displaced so as to remove the enlarged area from blocking the fluid outlet. Again, the balancing of forces maintains the valve element in its opened position.

BRIEF DESCRIPTION OF THE DRAWINGS

FIG. 1 is a cross-sectional side view of a valve according to the invention in its closed position and situated at the bottom end of the tubing string of a well;

FIG. 2 is a sectional side view of the valve of FIG. 1 shown in its opened position;

FIG. 3 is a cross-sectional view of the valve according to the invention taken along lines 3—3 in FIG. 1;

FIG. 4 shows a cross-sectional view of the valve according to the invention taken along lines 4—4 in FIG. 2;

FIG. 5 is an enlarged sectional view showing the shear pin connection taken along lines 5—5 in FIG. 2;

FIG. 5*a* is a partial, sectional view of the valve according to the invention showing an alternative sealing arrangement;

FIG. 6 is a sectional side view of an alternative embodiment of the valve according to the invention shown in its closed position and attached to a standard tubing plug in place of the usual check valve;

FIG. 7 is a side sectional view of the valve of FIG. 6 shown in its opened position;

FIG. 8 is a cross-sectional view taken along lines 8—8 in FIG. 6;

FIG. 9 is a cross-sectional view taken along lines 9—9 in FIG. 6;

FIG. 10 is a cross-sectional view taken along lines 10—10 in FIG. 7;

DETAILED DESCRIPTION OF THE PREFERRED EMBODIMENTS

Figure 12:
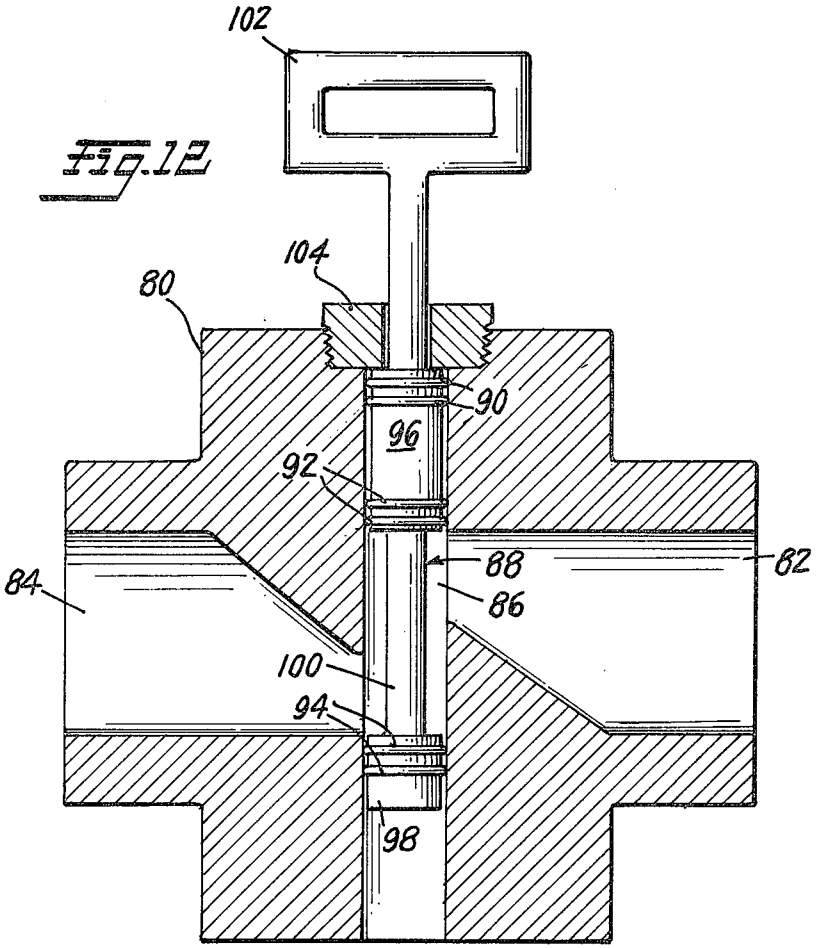
FIG. 12 is a side sectional view of the valve of FIG. 11 shown in its opened position.

FIGS. 1 through 5 show a first embodiment of the valve according to the invention in which the valve assembly, indicated generally at 10, is disposed within well tubing 12 having seating nipple 14 attached thereto. The valve assembly 10 comprises valve body 16 having valve stem 18 slidably retained therein through central aperture 20. Valve body 16 has a beveled radially outwardly extending annular ridge 22, the outer diameter of which is greater than the inner diameter of seating nipple 14 such that it rests upon the upper, chamfered edge of seating nipple 14. Rubber gasket 24 is retained on valve body 16 by any known means and serves to act as a seal between annular ridge 22 and seating nipple 14. Lower valve body 16*a* has opening 26 extending therethrough which communicates with lower well opening 28.

Opening 26, in turn, communicates with generally U-shaped passageways 30, each of such passageways comprising generally radially extending portions 30*a* and 30*b* and interconnecting longitudinal portions 30*c*. Although it has been found that eight of these passageways provide a sufficient volume of fluid flow through the valve, quite obviously any other number could be utilized depending upon the characteristics of each individual application. Radial portion 30*b* communicates with passageway 20 which extends longitudinally through the remainder of the valve body 16. Radial ports 32 permit fluid communication between the opening 20 and the interior of the well tubing 12. Again, eight radial ports 32 have been found to provide sufficient volumetric fluid flow, however, any number of such ports could be utilized without exceeding the scope of this invention. Valve body 16 also defines inner chamber 34 which communicates with opening 20 at its upper end.

Valve stem 18 is slidably retained in opening 20 through valve body 16 and its movement relative thereto is normally limited by shear pin 36. Shear pin 36 is fixedly attached to valve body 16 and has its radially innermost end extending into slot 38 in valve stem 18. Under normal circumstances, shear pin 36 limits the movement of valve stem 18 with respect to valve body 16. However, if the valve assembly 10 gets stuck in the well tubing 12 due to a crimp in the well tubing, etc., a force can be exerted on valve stem 18 which is sufficient to break shear pin 36 and allow the removal of the valve stem from the well. It is envisioned that a shear pin having a shear force of 2500 pounds would be used in such an environment, although shear pins having other shear values may be utilized.

Reduced diameter valve portion 40 interconnects distal end portion 42 with valve stem 18. The diameter of valve portion 40 is substantially smaller than the diameter of opening 20 to allow fluid passage from ports 32, opening 20 and passages 30*b* when the valve is in the opened position, as shown in FIG. 2. The diameter of distal portion 42 is substantially the same as that of valve stem 18. The areas of each of these elements that are exposed to the fluid pressure are also substantially equal, thereby negating any resultant force exerted on valve stem 18 by the fluid pressure within the valve body. Regardless of this pressure, the forces will substantially cancel each other out, thereby minimizing the external force required to move the valve stem 18 with respect to valve body 16. One or more O-ring seals 44 may be provided on valve stem 18 and distal portion 42 to prevent passage of fluid between these elements and the surrounding walls. O-ring seals 44 sealingly engage the interior of opening 20 and the interior of the wall defining chamber 34 as shown. The diameter of the valve stem located above the uppermost O-ring 44 may be made larger than the diameter of the remainder of valve stem 18 to reduce the possibility of cutting or deforming the O-rings as they pass by radial ports 32 during the opening and closing of the valve. Attaching portion 46 is rigidly attached to the upper end of valve stem 18 and may be internally threaded to receive rod 48 which extends upwardly for a sufficient distance (e.g. about 18 inches) to permit the attachment of a conventional fishing tool of a wire line assembly (not shown) by means of which the valve assembly may be lowered into the tubing string and/or the valve may be opened and the assembly pulled out of the tubing.

Valve body 16 also defines relief port 50 which, as shown best in FIG. 3, allows fluid to communicate between chamber 34 and the interior of well tubing 12, and permits the equalization of pressures therebetween. Relief port 50 prevents the increase in pressure in chamber 34 as valve stem 18 is moved downwardly, as shown in FIG. 1, thereby minimizing the force necessary to move valve stem 18. The portion of relief port 50 in chamber 34 may be defined by a semi-cylindrical arcuate passageway located in valve body 16 in the wall defining the lower surface of chamber 34, and a correspondingly oriented semi-cylindrical channel in the bottom portion of valve stem element 42. As is clearly shown in FIG. 3, relief port 50 does not communicate with any of the passages 30, but passes between them to provide a pressure relief for chamber 34. Relief port 50 also provides an entrance for fluid to enter chamber 34 as the valve stem 18 is moved upwardly to open the valve, thereby preventing the formation of a vacuum between distal portion 42 and the valve body 16 defining chamber 34. This also serves to minimize the force necessary to open the valve.

In operation, for hydrotesting a tubing string, the valve assembly with the valve stem in its lower position may be seated in the bottom section of tubing at the surface and this section and succeeding sections then lowered into the well, or the valve assembly may be lowered into an existing tubing string already in place in the well. In the latter case, the valve 10 is lowered down into well tubing 12 by way of rod 48 attached to the fishing tool of a wireline unit at the surface until sealing ring 24 contacts the upper chamfered edge of seating nipple 14, as shown in FIG. 2. During the lowering of the assembly, the valve is open and fluid communication between the well tubing above and below the valve is accomplished via radial ports 32, passage 20, passages 30 and opening 26. As mentioned above, the fluid pressure exerts no resultant force on valve stem 18 due to the substantially equal areas of valve stem 18 and distal end portion 42. The forces exerted on the opposed surfaces in the reduced diameter portion 40 cancel each other out. When the assembly is seated, valve stem 18 continues to move downwardly by inertia until upper O-rings 44 pass radial ports 32, as shown in FIG. 1. The fishing tool and wireline may be removed during hydrotesting of the tubing string. O-rings 44 seal against the interior of passageway 20 thereby preventing any fluid communication between radial ports 32 and passages 30. Once the hydrotesting has been completed, the valve 10 may be easily opened and the assembly removed regardless of the pressures existing within the tubing. Thus, the fishing tool may be lowered in the tubing by means of the wireline unit which is mechanically powered. The fishing tool "catches" rod 48 and the wireline operator will spool in his wireline until a slight resistance is felt. The resistance is caused by the bottom of slot 38 contacting shear pin 36. When this slight resistance is felt the wireline operator will stop his spool and wait until the pressure has equalized as the valve is open. When the pressure has equalized, usually within a few minutes, the entire valve assembly may then be easily withdrawn from the well with the wireline unit.

As an alternative to utilizing seal ring 24 to seal against the chamfered upper edge of seating nipple 14, chevron seals may be located on the lower valve portion 16*a*, as shown in FIG. 5*a*. Chevron seals 52 may be of any known variety and serve to seal against the inner surface of seating nipple 14, as shown. Chevron seals 52 may be retained in place by threadingly engaging a nut 54 with valve body portion 16*a*.

It is also envisioned that the concepts discussed above can be used in an equalizing valve on the bottom of an Otis mandrel, which is widely used in the oil and gas industry. A mandrel of this type (type W Otis mandrel MS 321) is used to seal off a portion of the well tubing by inserting the mandrel into the tubing and expanding an expander element against the inner sides of the tubing to make a pressure seal. The mandrel has a longitudinal passage extending through its length, the bottom of which is sealed by a check valve. Typically, this check valve is a type C Otis plug bean MS 356 and comprises a valve body which is threadingly engaged onto the bottom of the mandrel and contains a spring biased check valve therein. The check valve serves to seal off the passageway extending through the mandrel. The higher pressures in the lower portion of the well also exert a closing force on this check valve and, in the case of high pressure wells on the order of 2000 psi, renders the opening of the valve, necessary in order to remove the mandrel, extremely difficult and time consuming. The currently accepted procedure for opening such a valve is for the wire line operator to tap on the valve elements with a probe located on the fishing tool which removes the mandrel from the well tubing. The probe extends down through the longitudinal opening in the mandrel in order to contact the check valve. Each time the valve is contacted, it opens for an instant and lets a small amount of gas therethrough. This procedure is continued until the pressures on either side of the check valve are substantially equal, at which time the mandrel may be removed. This procedure is extremely time consuming and in high pressure wells, has taken as long as a day and a half in order to equalize pressures and remove the mandrel.

The principles of the instant invention can be utilized in a valve structure which replaces the standard type C Otis check valve on the bottom of the mandrel and substantially reduces the amount of time required for pressure equalization and removal of the mandrel. This embodiment of the invention is shown in FIGS. 6–10 and will be described in conjunction with a standard type W Otis mandrel. It is believed that this type of mandrel is well known in the industry and further detailed description of it is believed to be unnecessary. The lower portion of the mandrel is indicated as element 56 in FIGS. 6 and 7 and has passageway 58 extending therethrough along its longitudinal axis. The rubber element that is expanded against the inner surface of well tubing 60 is located above the portion of mandrel 56 shown in the drawings, and serves to seal off the inner well opening except for the passageway extending through the mandrel.

Valve body 62 is threadingly engaged onto the bottom of mandrel 56, the body being generally cylindrical with a central longitudinal opening 64 and a plurality of radially oriented ports 66 extending through the sidewall of valve body 62 so as to allow communication between longitudinal opening 64 and the interior of the well tubing 60. Cap 68 is threadingly engaged onto the opposite end of valve body 62 and may be provided with O-ring seal 70 to prevent fluid seepage into opening 64 around the threaded connection. Valve element 72 is slidably disposed in opening 64. Valve element 72 is generally cylindrical in nature and has O-ring seals 74 and 76 located adjacent its upper and lower ends, respectively. Pressure equalization port 78 extends through valve element 72 generally coincident with its longitudinal axis.

When the mandrel is to be inserted into the well tubing, the valve is threaded onto the bottom of the mandrel with the valve element 72 positioned as shown in FIG. 6. The positioning of the valve element is achieved by removing end cap 68 and manually moving valve element 72 against the lower portion of the mandrel, such that O-rings 74 and 76 are on either side of ports 66. In this position, the valve is closed and will prevent any fluid communication between ports 66 and mandrel passageway 58. Since the exterior of the mandrel is sealingly engaged against the interior of well tubing 60, all communication between the upper and lower portions of the well is cut off.

When it is desired to remove the mandrel, the standard fishing tool is attached thereto and its probe is inserted into longitudinal opening 58 such that it contacts the top of valve element 72. However, since the vertical forces of the well fluid on the valve element are equal and opposite, no resultant forces are generated on this element and, consequently, there is no excessive force tending to maintain the valve element in its closed position. The probe may easily push valve element 72 to its lowermost position as shown in FIG. 7, thereby quickly opening the valve and equalizing the pressures above and below the mandrel. Pressure equalization port 78 allows fluid communication between the ends of valve element 72 and, since they are of equal area, no resultant forces are generated on this element. Once the mandrel assembly has been removed from the well, valve element 72 may be manually moved to its closed position for subsequent usage. The elimination of any resultant forces acting on the valve element reduces the pressure equalization time, which has required a day and a half in the most severe cases, to a few minutes.

Figure 11:
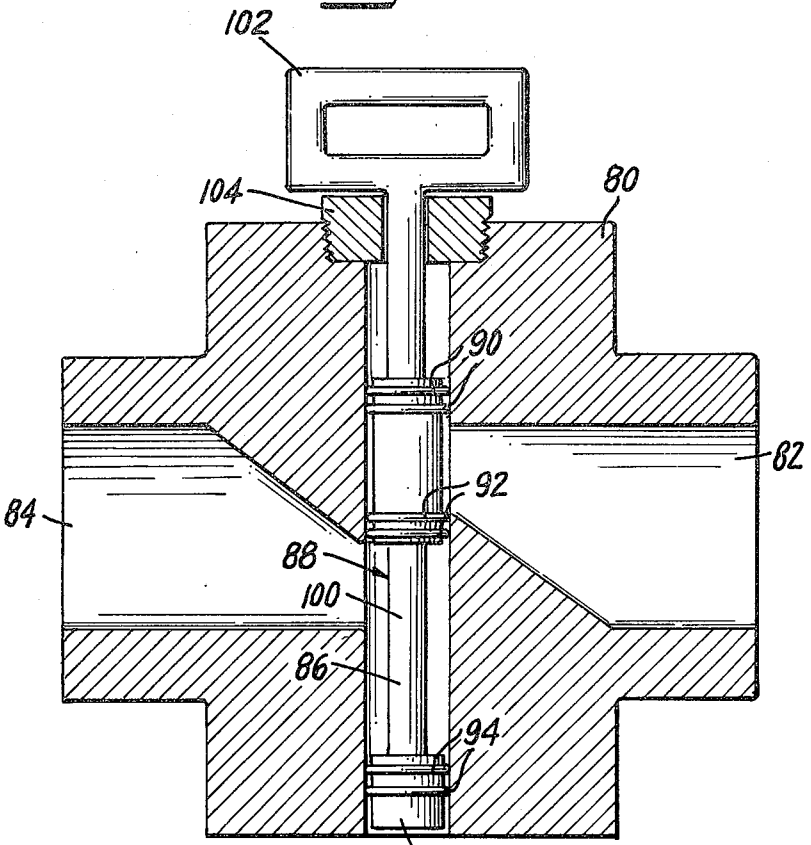
FIG. 11 is a side sectional view of a third embodiment of the valve according to the invention shown in its closed position.

The instant invention is also applicable to surface valves and is not merely restricted to valves utilized in a well environment. A surface valve utilizing applicant's invention is shown in FIGS. 11 and 12 and comprises valve body 80 defining ports 82 and 84 having a generally coincident longitudinal axis. Valve body 80 further defines passageway 86 having its longitudinal axis oriented generally perpendicular to the axes of ports 82 and 84. Valve element 88 is slidably disposed in passageway 86 and has a plurality of O-rings 90, 92 and 94 disposed thereon so as to sealingly engage the interior surface of passageway 86. Valve element 88 has enlarged end portions 96 and 98 interconnected by reduced diameter portion 100. Operating handle 102 is rigidly connected to portion 96 and may have a sealing or packing element 104 around its connection to prevent fluid leakage.

As shown in FIG. 12, when the valve is in the open position, reduced diameter portion 100 is disposed in passageway 86 and allows fluid communication between ports 82 and 84 through this passageway. O-ring seals 92 and 94 prevent fluid from leaking through the top or bottom of passageway 86. Since the areas of enlarged portions 96 and 98 exposed to the fluid are of equal areas, no resultant force is exerted on the valve element 88 by the fluid passing through the valve. In order to close the valve, handle 102 is pushed downwardly, which positions enlarged area 96 between the ports 82 and 84 such that O-rings 90 and 92 prevent fluid communication between ports 82 and 84, as shown in FIG. 11. Again, no resultant forces are generated on the valve assembly 88 by the fluid, since the forces acting on element 96 cancel each other out.

As can be readily seen from the description of the foregoing embodiments, applicants' invention provides a pressure balanced valve that requires minimal operative force to open or close the valves regardless of the fluid pressures associated with the system. The foregoing description of the preferred embodiments are for illustrative purposes only and should not be construed as in any way limiting the scope of coverage of this invention, which is solely defined by the appended claims.

What is claimed is:

1. A pressure balanced valve comprising:

(a) a valve body defining:

(i) a central aperture extending generally along a longitudinal axis of the valve body;

(ii) a plurality of radial ports communicating with the central aperture;

(iii) a lower opening;

(iv) an inner chamber having an open first end generally aligned with the central aperture and a closed second end; and, (v) a plurality of generally "U" shaped passageways disposed about the inner chamber and having a first end communicating with the lower opening and a second end communicating with the central aperture below the plurality of radial ports;

(b) a valve element slidably retained in the central aperture of the valve body and having first and second ends, and a reduced diameter portion adjacent the first end which defines opposite facing surfaces of substantially equal areas;

(c) first sealing means located between the first end and the reduced diameter portion and bearing against a wall of the inner chamber;

(d) second sealing means located between the reduced diameter portion and the second end of the valve element and bearing against a wall of the central aperture; and, (e) means to move the valve element with respect to the valve body between a closed position wherein the second sealing means is disposed in the central aperture between the plurality of radial ports and the second ends of the "U" shaped passageways so as to prevent fluid from passing therebetween, and an open position wherein the second sealing means is positioned in the central aperture so as to permit fluid flow between the plurality of radial ports and the "U" shaped passageways.

2. The pressure balanced valve of claim 1 wherein said valve body further defines a pressure relief port which allows fluid communication between said inner chamber and the exterior of said valve body so as to relieve the pressures acting on the first end of the valve element.

3. The pressure balanced valve of claim 2 wherein said pressure relief port extends laterally through said valve body and is partially defined by a semi-cylindrical groove in the closed end of the inner chamber and a correspondingly oriented, semi-cylindrical groove in the first end of said valve element.

4. The pressure balance valve according to any of claims 2, 3 or 1 further comprising a shear pin extending through a wall of the valve body defining the central aperture and into a slot in said valve element so as to normally limit the movement of said valve element with respect to said valve body.

5. The pressure balanced valve of claim 4 wherein said first and second sealing means are O-rings located in grooves in the valve element.

6. The pressure balanced valve of any of claims 2, 3, or 1 wherein said first and second sealing means are O-rings located in grooves in the valve element.

7. In an underground well structure having a tubing string extending down into the well, an improved pressure balanced valve assembly insertable into the tubing string comprising:

(a) a valve body having an exterior dimension smaller than the inner dimension of the tubing string, the valve body defining:

(i) a central aperture extending generally along a longitudinal axis of the valve body;

(ii) a plurality of radial ports communicating with the central aperture;

(iii) a lower opening;

(iv) an inner chamber having an open first end generally aligned with the central aperture and a closed second end; and, (v) a plurality of generally "U" shaped passageways disposed about the inner chamber and having a first end communicating with the lower opening and a second end communicating with the central aperture below the plurality of radial ports;

(b) a valve element slidably retained in the central aperture of the valve body and having first and second ends, and a reduced portion adjacent the first end which defines opposite facing surfaces of substantially equal areas;

(c) first sealing means located between the first end and the reduced diameter portion and bearing against a wall of the inner chamber;

(d) second sealing means located between the reduced diameter portion and the second end of the valve element and bearing against a wall of the central aperture; and, (e) means to move the valve element with respect to the valve body between a closed position wherein the second sealing means is disposed in the central aperture between the plurality of radial ports and the second ends of the "U" shaped passageways so as to prevent fluid from passing therebetween, and an open position wherein the second sealing means is positioned in the central aperture so as to permit fluid flow between the plurality of radial ports and the "U" shaped passageways.

8. The underground well structure and pressure balanced valve of claim 7, further comprising external sealing means located on said valve body and engageable with at least a portion of the interior surface of said tubing string so as to prevent fluid flow between said valve body and said tubing string.

9. The underground well structure and pressure balanced valve of claim 8 wherein said valve body further defines a pressure relief port which allows fluid communication between said inner chamber and the exterior of said valve body so as to relieve the pressures acting on the first end of the valve body so as to relieve the pressures acting on the first end of the valve element.

10. The underground well structure and pressure balanced valve of claim 9 wherein said pressure relief port extends laterally through said valve body and is partially defined by a semi-cylindrical groove in the closed end of said inner chamber and a correspondingly oriented, semi-cylindrical groove in the first end of said valve element.

11. The underground well structure and pressure balanced valve according to any of claims 8, 9 10 or 7 further comprising a shear pin extending through a wall of the valve body defining the central aperture and into a slot in said valve element so as to normally limit the movement of said valve element with respect to said valve body.

12. The underground well structure and pressure balanced valve of claim 11 wherein said tubing string includes a seating nipple and wherein said external sealing means comprises an annular resilient gasket attached to said valve body and engageable with said seating nipple to effect a fluid seal therebetween.

13. The underground well structure and pressure balanced valve of claim 11 wherein said tubing string includes a seating nipple and wherein said external sealing means comprises a resilient chevron seal disposed about said valve body and bearing against the interior surface of said seating nipple so as to prevent fluid flow therebetween.

14. The underground well structure and pressure balanced valve of any of claims 8, 9, 10 or 7 wherein said tubing string includes a seating nipple and wherein said external sealing means comprises an annular resilient gasket attached to said valve body and engageable with said seating nipple to effect a fluid seal therebetween.

15. The underground well structure and pressure balanced valve of any of claims 8, 9, 10 or 7 wherein said tubing string includes a seating nipple and wherein said external sealing means comprises a resilient chevron seal disposed about said valve body and bearing against the internal surface of said seating nipple so as to prevent fluid flow therebetween.

16. The underground well structure and pressure balanced valve of any of claims 8, 9, 10, or 7 wherein said first and second sealing means are O-rings located in grooves in the valve element.

* * * * *